United States Patent [19]

Pischinger et al.

[11] 4,455,543

[45] Jun. 19, 1984

[54] ELECTROMAGNETICALLY OPERATING ACTUATOR

[75] Inventors: Franz Pischinger, Im Erkfeld, 5100 Aachen, Fed. Rep. of Germany; Peter Kreuter, Aachen, Fed. Rep. of Germany

[73] Assignee: Franz Pischinger, Aachen, Fed. Rep. of Germany

[21] Appl. No.: 278,393

[22] Filed: Jun. 29, 1981

[30] Foreign Application Priority Data

Jun. 27, 1980 [DE] Fed. Rep. of Germany ..... 3024109

[51] Int. Cl.[3] ..... H01F 7/08

[52] U.S. Cl. ..... 335/266; 251/137

[58] Field of Search ..... 251/129, 131, 137; 335/256, 266, 268

[56] References Cited

U.S. PATENT DOCUMENTS 2,769,943 11/1956 Matthews ..... 251/137 X 3,190,608 6/1965 Hassa ..... 335/256 X 3,513,420 5/1970 Ransom et al. ..... 335/266 X

*Primary Examiner*—William M. Shoop

*Attorney, Agent, or Firm*—Watson, Cole, Grindle & Watson

[57] ABSTRACT

An electromagnetically operating actuator for control elements capable of making oscillatory movements in displacement machines, more particularly for flat slide shut-off valves and lift valves, includes a spring system and a pair of electrically operating switching elements, over which the control element is movable in two discrete opposite operating positions and is retained thereat by either switching magnet, the locus of the position of equilibrium of the spring system lying between the two operating positions. The invention is characterized by the provision of a compression device in engagement with the spring system for relocating the locus of the position of equilibrium of the spring system upon actuation of the compression device.

11 Claims, 9 Drawing Figures

ELECTROMAGNETICALLY OPERATING ACTUATOR

BACKGROUND OF THE INVENTION

The present invention relates generally to an electromagnetically operating actuator for control elements capable of making oscillatory movements in displacement machines, more particularly for flat slide shut-off valves and lift valves, comprising a spring system and two electrically operating switching magnets, over which the control element is movable in two discrete opposite operating positions and is retained thereat by either switching magnet, the locus of the position of equilibrium of the spring system lying between the two operating positions.

Displacement machines require an adaptive control to allow the working fluid to flow in and out for optimum control of the working process in order to achieve the objectives required in each case. The sequential control exerts a great influence on the various parameters, e.g., the conditions of the working fluid before, in, and after the working space, the operating frequency, and the processes in the working space. The need for adaptive control particularly exists in internal combustion engines, because under very different operating conditions they operate unsteadily and a suitably varied positive control of the gas-exchange valves is of advantage.

Heretofore, camshafts have essentially been employed to control the gas-exchange valves in internal combustion engines. However, they do not permit variable control. In addition, electromagnetic controls of gas-exchange valves are known in the art for internal combustion engines in which a spring applies the closing force to the gas-exchange valve, while the opening forces are generated by a properly controlled solenoid. This type of electromagnetic control has the disadvantage that short control periods in the case of high operating frequencies and conventional lifts of the gas-exchange valves can only be produced with extensive switchgear and with a great expenditure of energy (see, for example, DOS 28 15 849, and DOS 20 63 158). Furthermore, as exemplified by DOS 23 35 150, an electromagnetically operating control system for gas-exchange valves is disclosed for internal combustion engines, and comprises two water-cooled tapped winding coils each interacting with an armature. Both armatures are affixed to a common spindle which acts on the gas-exchange valve. As in the case of a cam control, this gas-exchange valve has a compression spring which holds the valve in a closed position. Another spring is provided with identical spring stiffness, which acts on either armature and is subjected to a compressive stress by the armature while the valve is closed. To operate such device, one solenoid is energized, while the other is de-energized. Owing to the initially stressed spring system, the valve spindle is accelerated with the armature until its half-stroke position is reached, where both armatures are spaced the same distance from their operating coils. These switching coils are designed in such a way that, after energization, they can attract their armatures from this central position against the intensifying force of the spring system. In the rest position of this arrangement, both armatures also place themselves in their middle position, so that the gas-exchange valve has already reached its half-stroke position, causing it to open.

This arrangement has the drawback that for all practical purposes it cannot be employed in internal combustion engines, because stopping the internal combustion engine, in some cases over fairly long periods of time with the gas-exchange valves open in all cylinders, can lead to corrosion in the cylinders. Another disadvantage is that in order to start an internal combustion engine so equipped, the switching coils must be designed for attracting an armature beyond the half-stroke position for great forces over large distances, which means very substantial energy requirements for starting a multicylinder internal combustion engine. Furthermore, a disadvantage in such an arrangement is that, because of the large masses of the two plunge armatures to be accelerated, a high switching frequency can only be produced by means of considerable spring tensions, so that the necessary magnetic forces and, thereby, the energy requirements are greatly increased.

SUMMARY OF THE INVENTION

Therefore, it is an object of the invention to provide, for the type of aforementioned device, a variable actuator with modest space requirements, which is easy to construct and which can be operated with a small expenditure of control and power.

According to the invention, this object is achieved by the provision of a spring system connected to a compression device so that the locus of the position of equilibrium of the spring system can be relocated. The invention is based on the knowledge that a low power consumption of the switching magnets can only be achieved if the locus of the position of equilibrium of the spring system can be relocated in order to start the actuator. Thus, the switching magnets do not have to attract the control element from the position of equilibrium of the spring system during start-up, for which a great amount of energy is required, depending on the contact travel or spool stroke. Since not much current is needed to operate the control element itself, the total power consumption of the arrangement embodying the invention is very low. This has the additional advantage that the amount of heat generated in the switching magnets is small, so that they require no separate cooling. Because of the low power consumption, it is also possible to use the actuator provided by the invention to control the gas-exchange valves in internal combusion engines. According to the invention, it does not matter whether the locus of the position of equilibrium of the spring system is relocated during de-energization or not until startup.

One embodiment of the invention provides that the compression device has at least two discrete positions where the locus of the position of equilibrium of the spring system lies between the operating positions in the primary position of the compression device and in the area of one of the operating positions in the secondary position of the compression device. In such case, it is advisable to allow the compression device to move to its secondary position at least for starting the actuator. It is also possible to take up this position in the period when the actuator is not in use. This is particularly advisable when a gas-exchange valve of internal combustion engines is provided as the control element. In this way it is possible to maintain the gas passage closed by means of the gas-exchange valve when the internal combustion engine is switched off. The primary position of the compression device is reached only when the actuator is in operation. However, it is important to note that through appropriate control of the switching magnets the locus of the position of equilibrium of the spring system, when the compression device is in the primary position, is not a locus of the rest position, but only a locus which is reached for a short period during the operation of the control element.

As a compression device within the scope of the invention any device may be provided which varies with the control element used and operates via mechanical, hydraulic, pneumatic or electric means. The compression device may be in the form as set forth of a solenoid. If gas-exchange valves of an internal combustion engine are provided as control elements, it is advisable to provide, for example, as a compression device for all gas-exchange valves a common shaft which is either mounted eccentrically, or acts on the spring system by means of appropriate levers and which is moved to its two discrete positions by a common switching unit, e.g., an electric motor or a hydraulic cylinder.

If an electric motor is provided as a compression device, it is advisable to energize it in its primary position and deenergize it in its secondary position for control. This has the advantage that the de-energized position of the compression device corresponds to the de-energized position of the actuator, so that no energy is required in the de-energized condition. Another advantage is that in the primary position there is no reduction in the field strength, so that the magnet requires only a small amount of energy.

The compression device in the form of a solenoid can be energized more slowly than the switching magnets, and has the advantage that the actuator can move the control element with a high frequency, because the electromagnet fields generated by the switching magnets can be set up and be made to collapse with high frequency at low voltage peaks. This is accomplished by a small inductance of the switching magnets. The solenoids of the compression device can be energized substantially more slowly, that is to say, provided with a substantially higher inductance, because its operating frequency is substantially lower, since during the operation of the actuator it remains in either discrete position and shall be switched into the other position at least for the start-up.

When the compression device is switched to its secondary discrete position already upon switching off the actuator, that is to say, the locus of the position of equilibrium of the spring system is in the region of either operating position, all the switching magnets of an actuator can be energized simultaneously to start the actuator. Because of the slower excitability of the solenoid of the compression device, the switching magnets can retain the control element in either operating position so that the compression device is prevented, during start-up, from relocating the locus of the position of equilibrium between the two discrete operating positions.

Owing to the design features of the actuator embodying the invention, it is possible to define the forces of the switching magnets in such a way that they are greater than the opposing forces of the spring system shortly before reaching the operating positions of the control element. Thus, switching magnets may be employed with a small force of attraction but with considerable holding powers when there is practically no air gap between magnet and armature.

In order to minimize the masses to be accelerated and, thereby, the holding forces to be generated by the switching magnets, a single armature may be disposed between the switching magnets, such armature being connected to the control element which may be in the form of a poppet valve. This permits simultaneous increase of the operating frequency owing to the small masses to be accelerated.

For the operation of the actuator embodying the invention, it does not matter where the spring system acts on the actuator. If only one armature is provided for both switching magnets, it is of advantage to allow the spring to act on this armature and in this case it is of no consequence whether the spring system comprises two opposing springs or one tension spring.

Both switching magnets may be energized during the operation of the actuator, and the switching magent which abuts the armature can be de-energized for a short period so as to move the control element. This has the advantage that in order to restore the magnetic field of the switching magnet with which the control element is not in abutting engagement, the total switching time is available, that is to say, the time the armature needs to travel to the other switching magnet and to return from there. In addition, such an arrangement reduces the amount of control required for the actuator embodying the invention, because only an output signal of short duration is now needed to operate the actuator.

The armature can be secured to the control element via resilient components having high spring stiffness. This has the advantage of preventing deviations from the nominal masses between the bearing surface or valve land of the control element and the pole areas of the switching magnets which are caused by fitting tolerances, thermal expansions, and wear and may interfere with the two discrete positions of the control element being reached with certainty. Advantageously, these springs are made substantially stiffer than the spring system.

And, damping elements may be provided between the armature and the control element so that the control element does not strike its discrete positions with great force, but is decelerated as it approaches them.

DETAILED DESCRIPTION OF THE INVENTION

Figure 1:
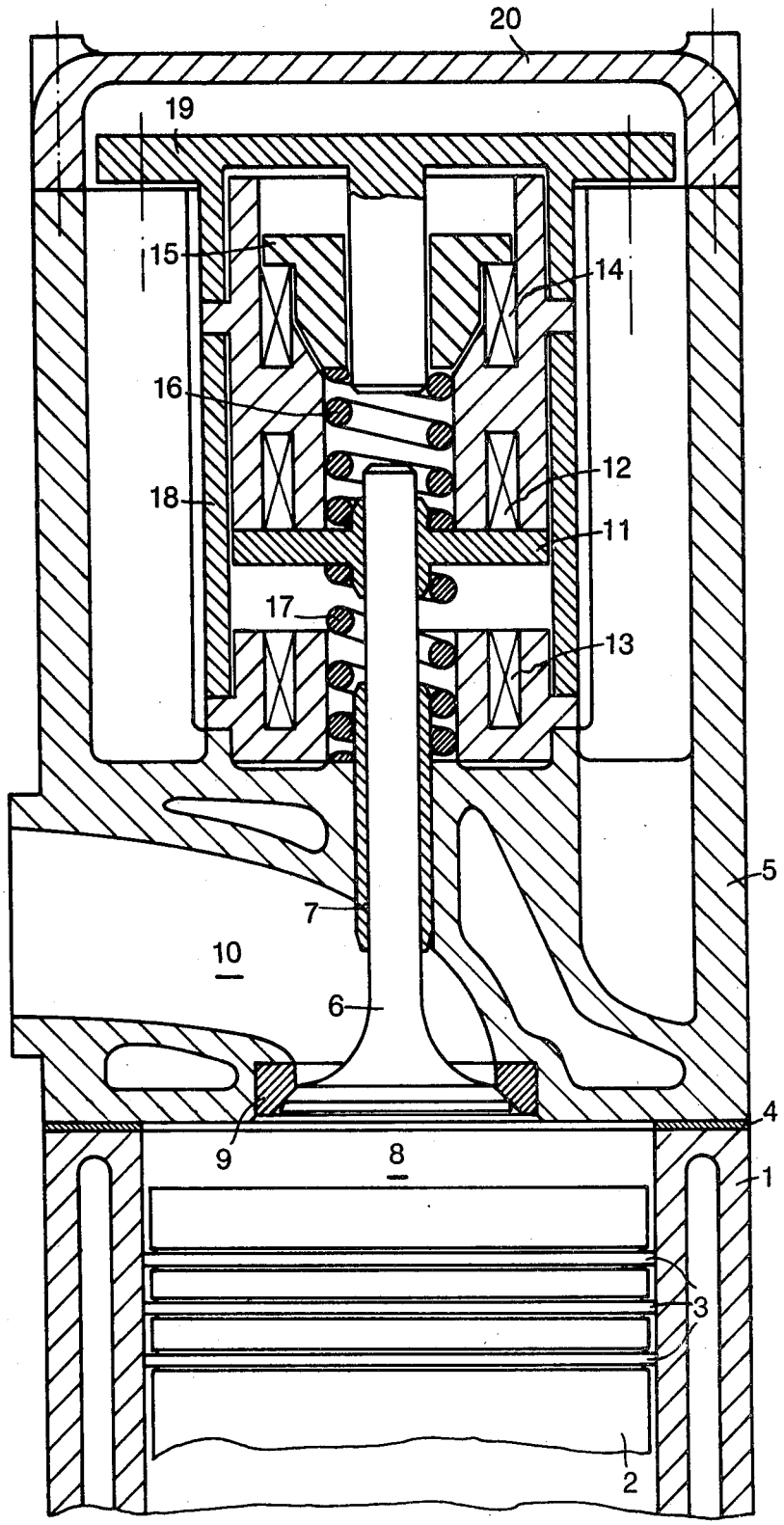
FIGS. 1 to 4 are cross-sectional views taken through the actuator embodying the invention with a gas-exchange valve of a reciprocating internal combustion engine as the control element.

The actuator according to the invention is described herein as control elements used in internal combusion engines, but it is not limited thereto. Generally, it is possible to adapt the actuator embodying the invention to all control elements which are capable of making oscillatory movements and shall have two discrete positions only.

The internal combustion engine shown schematically in FIGS. 1 to 4 comprises a cylinder block 1, a piston 2 with piston rings 3, a cylinder head seal 4, a cylinder head 5, as well as a poppet valve 6 positioned within a valve guide 7 and sealing off the combustion space 8 together with its valve seat ring 9 from a gas passage 10.

The actuator embodying the invention for poppet valve 6 comprises an armature 11 mounted on the stem of the valve 6 and two switching magnets or tapped winding coils 12, 13, the tapped winding coil 12 functioning as a closing coil and the tapped winding coil 13 as an opening coil. A spring system comprising springs 16 and 17 bear against the armature 11. The compression spring 17 is a conventional valve spring which applies a force to the poppet 6 in the direction of closing. The spring 16 is mounted such as to apply a force to the poppet valve 6 in the direction of opening.

The compression spring 16 coacts with a bias armature 15 associated with a bias coil 14 and forms a compression device. In the example shown in FIG. 1, the bias armature 15 abuts against the bias coil 14 so that the compression spring 16 is subjected to a compression stress. To accomplish this, the bias coil 14 must be energized. In order for the poppet valve 6 to remain in the closed position shown, it is further necessary to energize the closing coil 12 so that the armature 11 is retained thereon against the tension of the compression spring 16. The position of the actuator shown in FIG. 1 corresponds to an operating position, viz. the operating position "poppet valve 6 closed". In this position, the valve spring 17 is at its maxiumum length, so that the force it applies to the armature 11 is minimal.

The distance spacer 18 and the magnet cover 19 serve to affix the tapped winding coils 12, 13 and the bias coil 14 in the cylinder head 5, which is closed by the cover 20 at the top.

Figure 7:
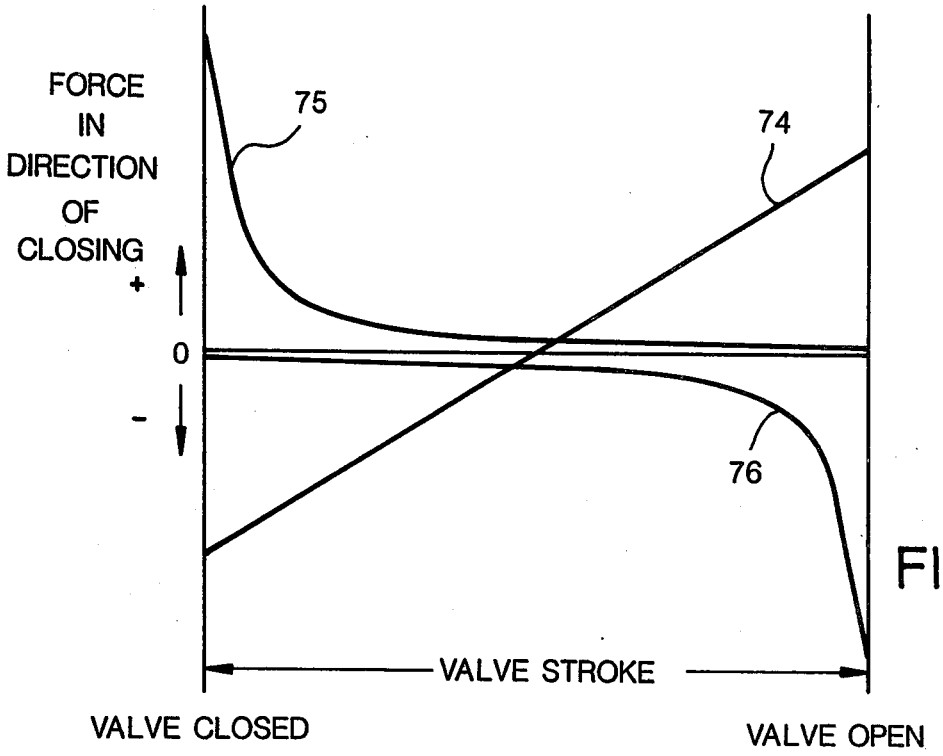
FIGS. 7 and 8 are load vs. displacement diagrams of the control element embodying the invention.
Figure 8:
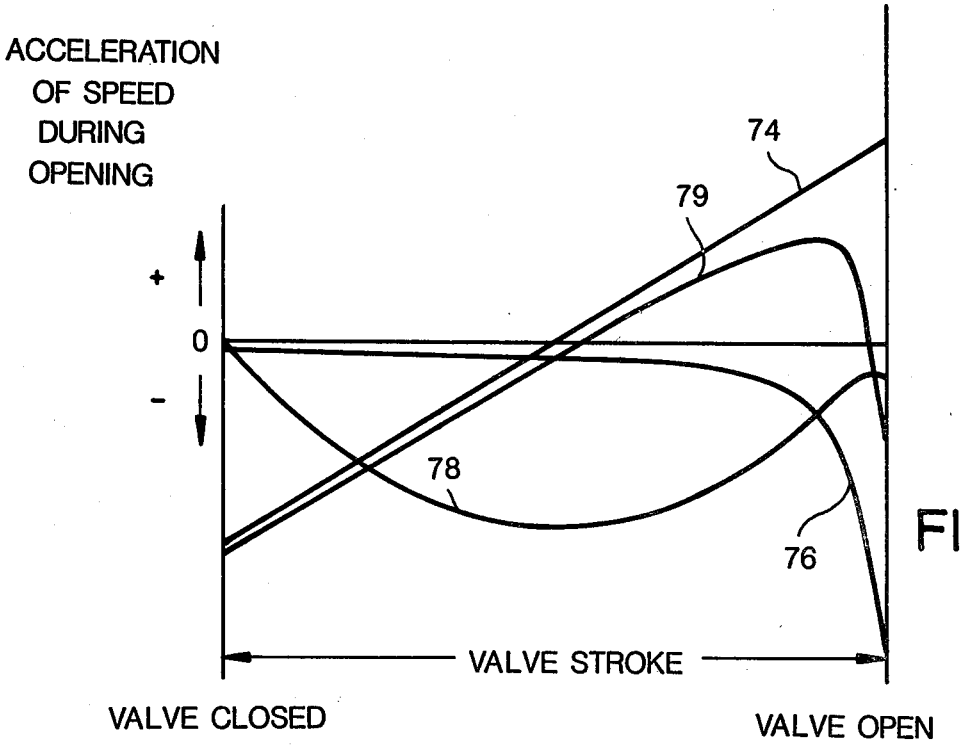

The operating principle of the device embodying the invention will now be described with reference to the diagrams shown in FIGS. 7 and 8. In FIG. 7, the forces in the direction of closing are indicated on the y-coordinate with plus and minus in the direction of opening. The possible stroke of the poppet valve 6 is plotted on the x-coordinate. FIG. 8 also shows on the y-coordinate acceleration and speed during the opening procedure, which is also plotted positively in the direction of closing.

It should be pointed out that, in a spring-mass system, comprising for example compression spring 16 axially aligned with valve spring 17 with a mass disposed therebetween, the location of the position of equilibrium of the system is where the mass rests, i.e., where the mass ceases to move after it is no longer excited or vibrated. In other words, this is the statical balance of the spring system. In the actuator according to the invention, the mass of the spring system comprises the mass of valve 6 and armature 11 disposed between springs 16 and 17.

When the actuator in FIG. 1 is switched off, that is to say, when none of the coils 12, 13 and 14 is energized, the bias armature 15 is in its quiescent position as it abuts against the magnet cover 19 under the force of spring 16. This causes the compression spring 16 to unstretch, so that the valve spring 17 presses the poppet valve 6 with the armature against the closing coil, thereby closing the combustion space 8. The spring characteristics of springs 16 and 17 are such that, when taking into account the various deviation possibilities or pre-stressing of the springs depending on the various positions of bias armature 15, the static position of rest, or the location of the position of equilibrium, of the spring system, when the coils are de-energized, is near closing coil 12, so that the mass (armature 11 and valve 6) disposed between springs 16 and 17 is shifted to this static position of rest. This assures that valve 6 is basically in a closed position when the internal combustion engine is turned off, and closes gas passage 10 to combustion space 8.

To energize the actuator embodying the invention, all three coils are energized simultaneously. However, because the bias coil 14 has a substanially higher inductance than the two tapped winding coils 12 and 13, and because of the smaller air gap between armature 11 and closing coil 12, as compared to the larger air gap between armature 11 and opening coil 13 (as clearly seen in each of the FIGS. 1 to 4), armature 11 is attracted by the closing coil and remains in a closed position.

Moreover, due to the slight inductance of the closing coil 12, the latter sets up its magnetic field faster than the bias armature 15 can be attracted by the bias coil 14. Thus, the armature 11 remains on the closing coil 12 so that the poppet valve 6 remains closed. The bias armature 15 is attracted after a build-up of the magnetic field of bias coil 14, so that spring 16 is compressed, whereby, simultaneously, the location of static rest shifts in the direction of opening coil 13, so that the mass (armature 11 and valve 6) has the tendency, when switching off closing coil 12, to move in the direction of the location of static rest. Thus, the movement energy need not be provided by opening coil 13. The actuator according to the invention may therefore be operated with little energy consumption and requires little space due to its small size.

Thus, as shown in FIG. 7, the spring system (line 74) applies a negative force to the armature 11 in the direction of closing. However, this force is smaller than the holding force of the closing coil 12 (curve 75). In the closed position of the poppet valve 6, the force applied by the opening coil 13 (curve 76) in the direction of closing is practically zero.

To open the poppet valve 6, the closing coil 12 is switched off for a short period. As apparent from FIG. 7, this causes the spring system to apply its full force in the direction of opening, so that the armature 11 with the poppet valve 6 is accelerated in the direction of opening. As shown in FIG. 7, the coil 12 can be re-energized almost immediately, because after the poppet valve 6 has traveled a short stroke length, the force of attraction of coil 12 is already smaller than the opening force of the spring system.

FIG. 7 also shows that virtually no additional force is applied to the moving poppet valve 6 at half-stroke. Thus, all the potential energy available in the direction of closing of the valve has been converted into kinetic energy. As shown in FIG. 8, this causes the poppet valve 6 to move with its armature 11 beyond the half-stroke position (curve 79). The maximum speed (curve 78) is reached at the half-stroke position.

After passing beyond the half-stroke position, the valve spring 17 has a retarding effect. At the same time the force of the opening coil 13 applied to the armature 11 intensifies with increasing distance from the half-stroke position. This means that the acceleration of the poppet valve 6 and of its speed is reduced.

As readily apparent from the acceleration curve 79, the acceleration is reversed shortly before reaching the opening position. This means that the poppet valve 6 is retarded as it approaches the opening position, so that the armature 11 is prevented from striking the opening coil 13 with force.

Figure 2:
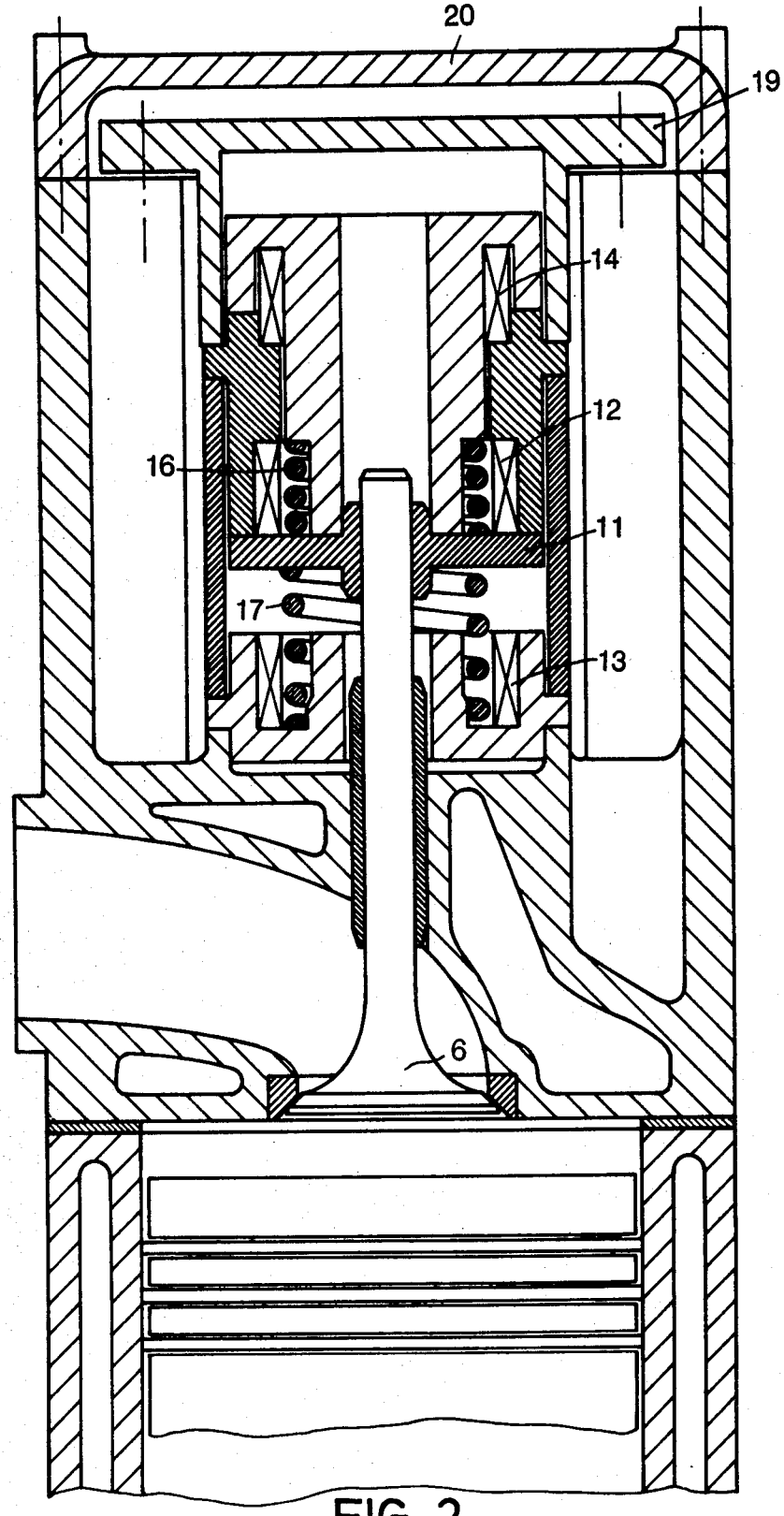

The embodiment of FIG. 2 differs from that of FIG. 1 in that the springs 16, 17 are disposed inside tapped winding coils 12, 13, while in FIG. 1 they are mounted in laminated cores interacting with the tapped winding coils.

Figure 3:
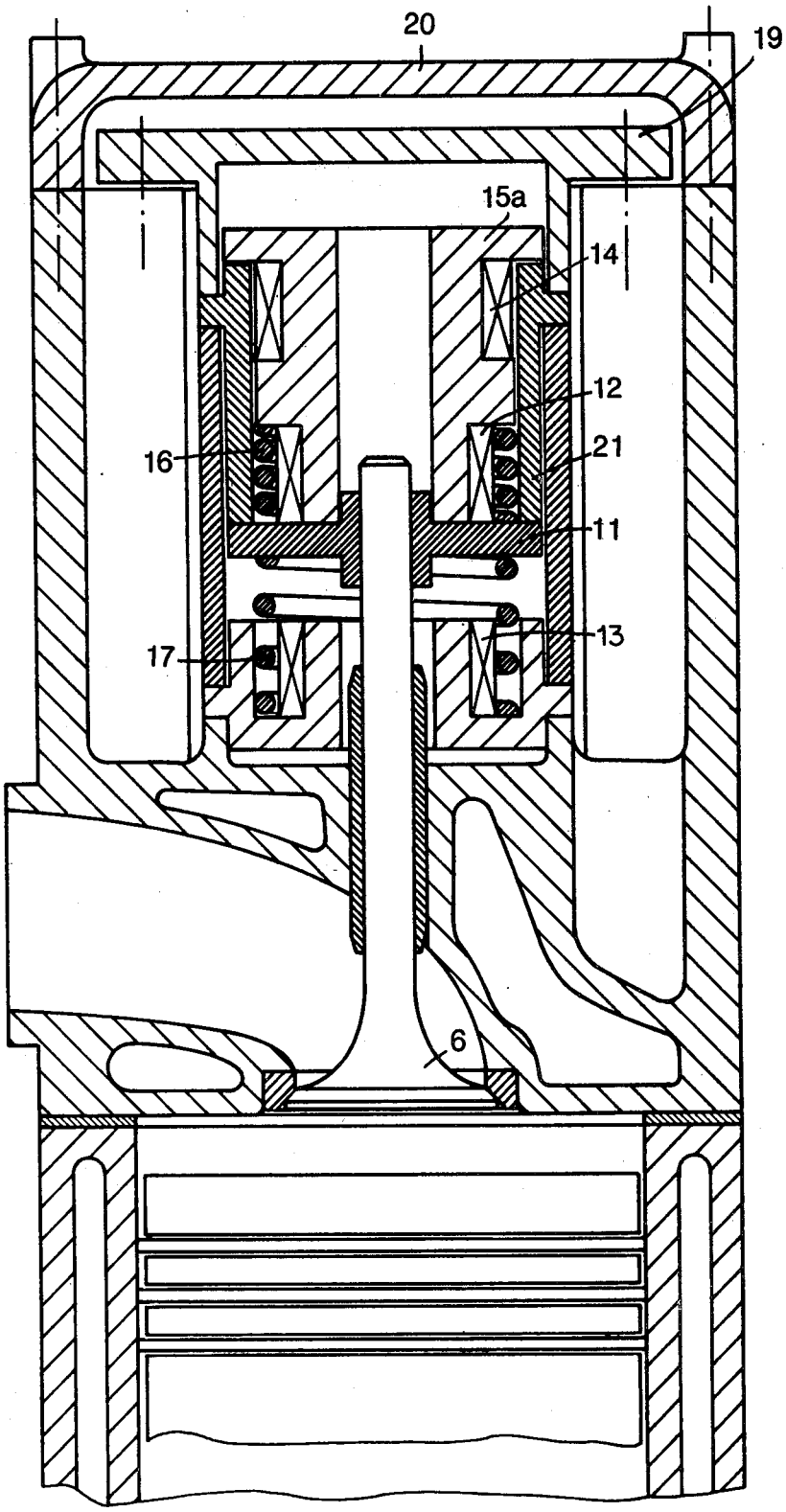

In FIG. 3, the two springs 16, 17 surround and enclose the two tapped winding coils 12, 13. Another difference is that the bias armature 15*a* serves as a support for the bias coil 15 and the tapped winding coil 12. Therefore, it is necessary for the valve spring 17 to press the armature 11 in its rest position against a bushing 21 held in place by the magnet cover 19.

Figure 4:
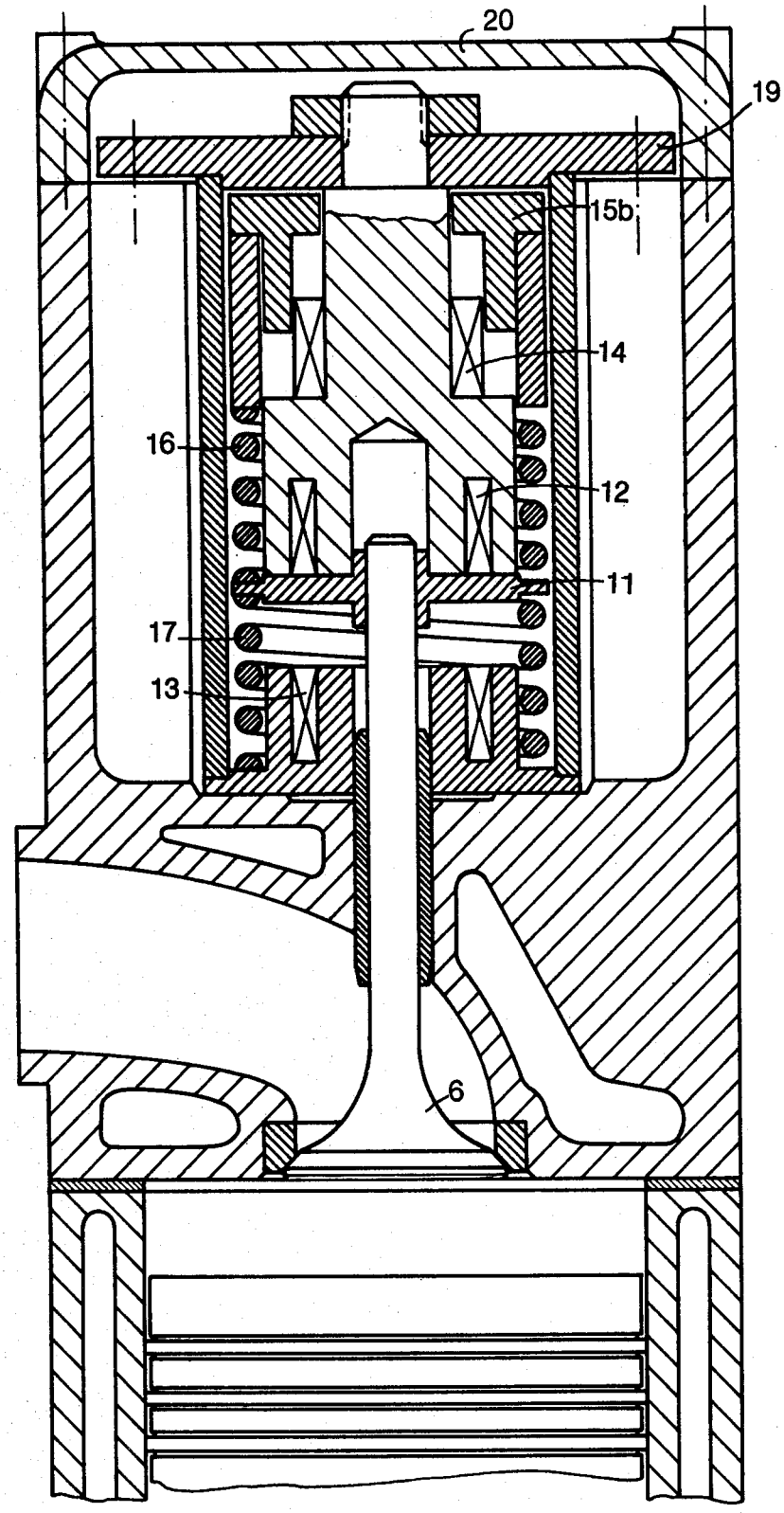

FIG. 4 shows another alternative arrangement of the springs 16, 17. In this case, they surround the tapped winding coils 12, 13. FIG. 4 also shows the rest position of the actuator embodying the invention. As mentioned earlier, in this position the bias armature 15*b* is pressed against the magnet cover 19 by the unstretching spring 16. In this way, virtually all of the full force of the valve spring 17 is brought to bear on the armature 11, so that the armature 11 and, thereby, the poppet valve 6, remain in their closed position.

Figure 5A:
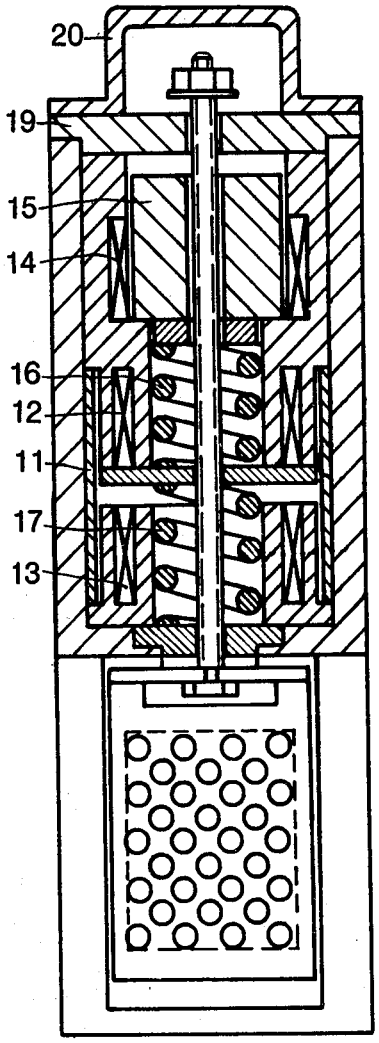
FIGS. 5A and 5B are cross-sectional front and side views taken through the control element with a flat slide shutoff valve as the control element.
Figure 5B:
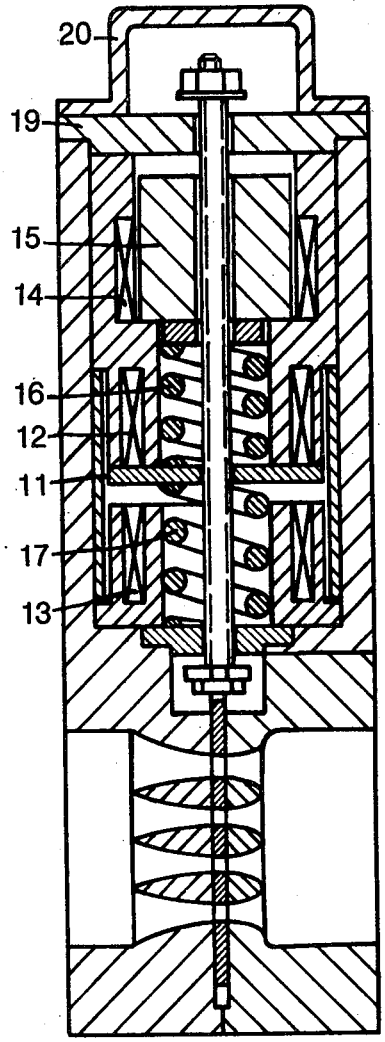

In FIGS. 5A and 5B the actuator embodying the invention is shown with the aid of a flat slide shut-off valve. Its design features and mode of operation are not different from the arrangements described earlier. The design features and operating principle of the flat slide shut-off valve are described in DOS 29 29 195 and therefore need not be described in detail herein.

Figure 6:
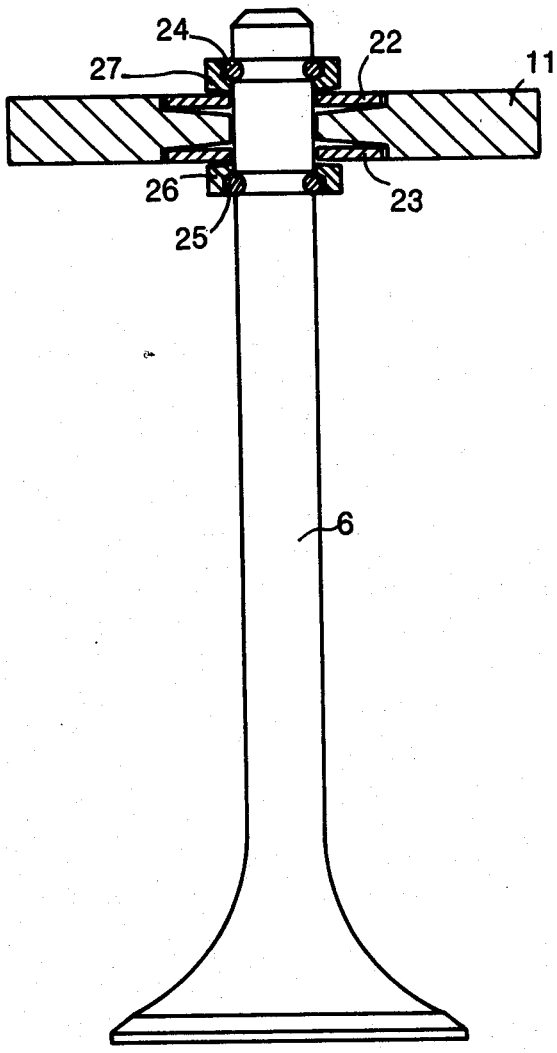
FIG. 6 is a detail view of the securement of the armature to the shaft of a control elment.

FIG. 6 shows a type of elastic mounting for the armature 11 on the shaft of the control element, in this case the poppet valve 6. The armature 11 is locked in place between a pair of disc springs 22 and 23. These springs are initially stressed and are located on the stem of the poppet valve by means of insert rings 24 and 25 which are prevented from falling out by the circlips 26 and 27. The disc springs 22 and 23 have considerable spring stiffness, so that the relative movements between the stem of the poppet valve 6 and the armature 11 are dampened by the friction of the disc springs 22 and 23 on the armature 11.

What is claimed is:

1. An electromagnetically operating actuator for a control element capable of making oscillatory movements in a displacement machine, more particularly for flat slide shut-off valves and lift valves, comprising a spring system and two electrically operating switching magnets over which the control element is movable in two discrete opposite operating positions and is retained thereat by either switching magnet, the locus of the position of equilibrium of the spring system lying between the two operating positions, characterized in the provision of a compression device in engagement with the spring system for relocating the locus of the position of equilibrium of the spring system upon actuation of the compression device.

2. The electromagnetically operating actuator as set forth in claim 1, characterized in that the compression device has at least two discrete positions, the locus of the position of equilibrium of the spring system being located between the operating positions in a primary position of the compression device and, in the area of either of said operating positions, in a secondary position of the compression device.

3. The electromagnetically operating actuator as set forth in claim 1 or 2, characterized in that the compression device comprises a solenoid.

4. The electromagnetically operating actuator as set forth in claim 3, characterized in that the solenoid of the compression device is energized in the primary position and is de-energized in the secondary position.

5. The electromagnetically operating actuator as set forth in claim 3, characterized in that the solenoid of the compression device is such as to be capable of being energized more slowly than the switching magnets.

6. The electromagnetically operating actuator as set forth in claim 1 or 2, characterized in that the forces of the switching magnets are greater than the opposing forces of the spring system only shortly before reaching the operating positions.

7. The electromagnetically operating actuator as set forth in claim 1 or 2, characterized in that a single armature is disposed between the switching magnets, the armature being connected to the control element.

8. The electromagnetically operating actuator as set forth in claim 7, characterized in that the spring system bears against the armature.

9. The electromagnetically operating actuator as set forth in claim 1 or 2, characterized in that both switching magnets are energized during the operation of the actuator and that one of the switching magnets abuts against the armature and can be de-energized for a predetermined period of time to effect movement of the control element.

10. The electromagnetically operating actuator as set forth in claim 7, characterized in that the armature is secured to the control element by means of resilient components each having a high spring stiffness.

11. The electromagnetically operating actuator as set forth in claim 7, characterized in that dampening elements are provided between the armature and the control element.

* * * * *